US010361044B1

(12) United States Patent
Xydis et al.

(10) Patent No.: US 10,361,044 B1
(45) Date of Patent: Jul. 23, 2019

(54) BUTTON FEATURES AND ARCHITECTURE OF A PORTABLE ELECTRONIC DEVICE

(71) Applicant: Apple Inc., Cupertino, CA (US)

(72) Inventors: Christopher R. Xydis, San Francisco, CA (US); Francisco De La Paz, Jr., Fremont, CA (US)

(73) Assignee: Apple Inc., Cupertino, CA (US)

( * ) Notice: Subject to any disclaimer, the term of this patent is extended or adjusted under 35 U.S.C. 154(b) by 21 days.

(21) Appl. No.: 15/481,314

(22) Filed: Apr. 6, 2017

Related U.S. Application Data

(60) Provisional application No. 62/383,988, filed on Sep. 6, 2016.

(51) Int. Cl.

| | |
|---|---|
| ***H01H 3/12*** | (2006.01) |
| ***H01H 13/06*** | (2006.01) |
| ***H01H 11/00*** | (2006.01) |
| ***H01H 9/04*** | (2006.01) |

(52) U.S. Cl.
CPC ..... *H01H 13/06* (2013.01); *H01H 3/122* (2013.01); *H01H 9/04* (2013.01); *H01H 11/00* (2013.01); *H01H 2231/022* (2013.01)

(58) Field of Classification Search
CPC ..... H01H 13/06; H01H 3/125; H01H 3/122; H01H 9/04; H01H 2231/022
See application file for complete search history.

(56) References Cited

U.S. PATENT DOCUMENTS

| | | | | |
|---|---|---|---|---|
| 4,384,796 A * | 5/1983 | Denley | ..... | H01H 3/122 200/344 |
| 5,941,373 A * | 8/1999 | Cheng | ..... | H01H 3/122 200/344 |
| 6,632,039 B2 * | 10/2003 | Lin | ..... | H01H 3/122 400/490 |
| 9,666,387 B2 * | 5/2017 | Sheng | ..... | H01H 13/063 |

* cited by examiner

*Primary Examiner* — Felix O Figueroa
(74) *Attorney, Agent, or Firm* — Dickinson Wright RLLP

(57) ABSTRACT

An electronic device having a button assembly fitted with an enclosure of the electronic device is disclosed. The button assembly may include a button connected to a first protrusion and a second protrusion, both of which extend through a first through hole and a second through hole, respectively, of the enclosure. The electronic device may include a liquid-resistant electronic device. The button assembly may include sealing elements fitted on the protrusions to plug, or seal, the through holes. The button assembly may include a clip that secures the button assembly with the enclosure. The button assembly may include a bar secured with the first protrusion and the second protrusion. When an "off-center" force is applied to an end of the button, the bar is designed to distribute the force so that the other end of the button is actuated and the button remains generally parallel with respect to the enclosure.

20 Claims, 9 Drawing Sheets

BUTTON FEATURES AND ARCHITECTURE OF A PORTABLE ELECTRONIC DEVICE

CROSS-REFERENCE TO RELATED APPLICATION(S)

This application claims the benefit of priority to U.S. Provisional Application No. 62/383,988, filed on Sep. 6, 2016, and titled "BUTTON FEATURES AND ARCHITECTURE OF A PORTABLE ELECTRONIC DEVICE," the disclosure of which is incorporated herein by reference in its entirety.

FIELD

The following description relates to electronic devices. In particular, the following description relates to input features, such as buttons, of an electronic device. The input features are modified to include water-resistant features.

BACKGROUND

Electronic devices are known to include a display assembly that presents visual information viewable by a user. In order to control the display assembly, an electronic device includes a button that can be depressed by a user, causing a switch to close and a signal to (corresponding to a command or input) to a processor circuit of the electronic device. The button is located at or near outer perimeter of the electronic device.

However, in order for the button to engage the switch (located in a housing of the electronic device), the electronic device must include an opening (or openings). The opening(s) create a pathway for dust or other contaminants, such as liquids, that can enter the electronic device cause damage to components, such as the processor circuit.

SUMMARY

In one aspect, a button assembly for an electronic device that includes an enclosure having a through hole is described. The button assembly may include a button. The button assembly may further include a protrusion extending from the button and at least partially positioned in the through hole. The button assembly may further include a sealing element fitted onto the protrusion and engaging the enclosure at the through hole. The sealing element may provide a seal that prevents liquid from passing into the enclosure via the through hole.

In another aspect, an electronic device is described. The electronic device may include an enclosure that defines an internal volume. The enclosure may include a first through hole and a second through hole. The electronic device may further include a button including a first protrusion extending through the first through hole and a second protrusion extending through the second through hole. The first protrusion and the second protrusion can at least partially extending into the internal volume. The electronic device may further include a first sealing element fitted onto the first protrusion and engaging the first through hole to form a first liquid barrier. The electronic device may include a second sealing element fitted onto the second protrusion and engaging the second through hole to form a second liquid barrier.

In another aspect, a method for assembling a button assembly with an electronic device that includes an enclosure having a first through hole and a second through hole is described. The method may include extending a first protrusion of a button through the first through hole and a second protrusion of the button through the second through hole. The method my further include securing a clip with the first protrusion and the second protrusion. In some embodiments, the first protrusion includes a first sealing element that seals the first through hole. Also, in some embodiments, the second protrusion includes a second sealing element that seals the second through hole.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
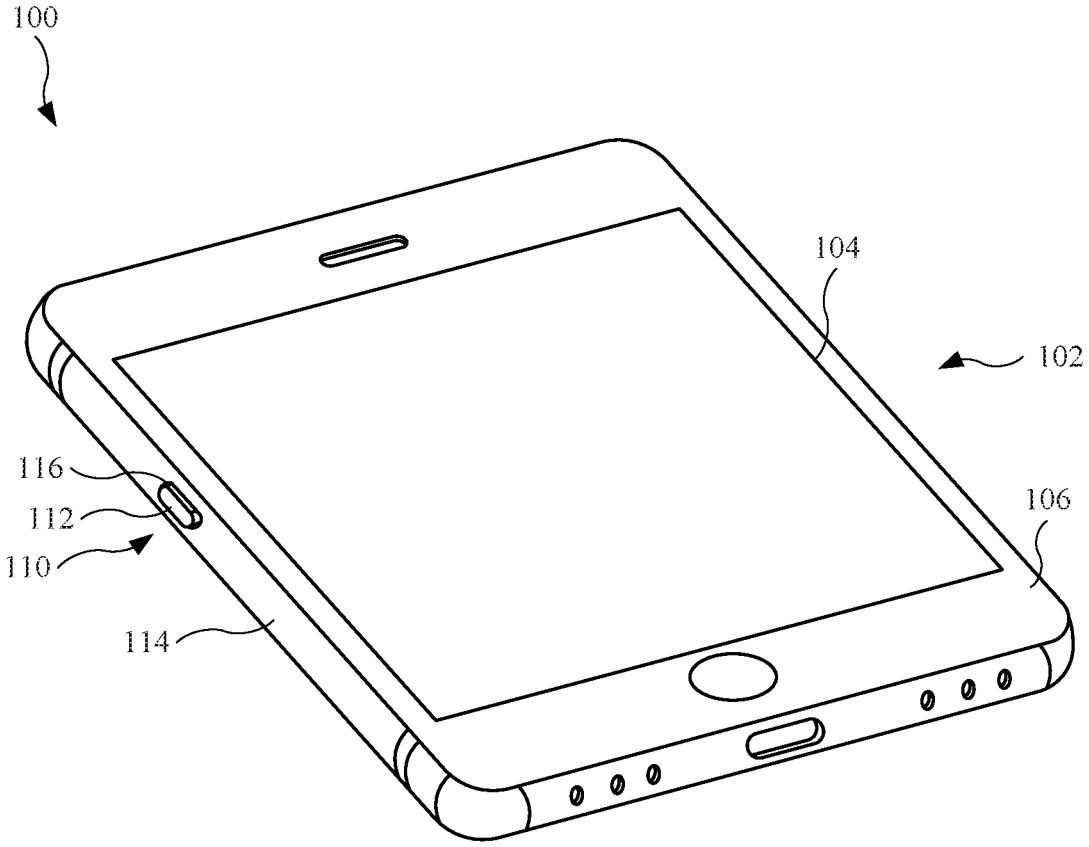
FIG. 1 illustrates an isometric view of an embodiment of an electronic device, in accordance with some described embodiments.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

The following disclosure relates to a button assembly of an electronic device. The button assembly includes a button designed to actuate a switch to provide an input or control to the electronic device. To accommodate the button (or buttons), the electronic device includes an enclosure, or housing, having an opening (or openings), also referred to as through holes, for the button(s). In order to provide the electronic device with liquid-resistant capabilities, the button assembly can be modified to seal off the openings associated with the button assembly. In this regard, the button assembly may include a button that is connected protrusions passing through the openings. Each protrusion may include a sealing element, in the form of compressible ring, which engages an opening through which the respective protrusion passes. When the button is depressed (or actuated by a user), the sealing elements allow movement of the protrusions (in accordance with the depression), while also preventing or limiting liquid ingress through the openings.

The button assembly may include additional structural components. For example, the button assembly may include a clip positioned in the enclosure and secured with the protrusions. When the clip is in place, the location of the clip relative to the switch can be measured and determined by automated means (such as a camera assembly with three-dimensional image capture capabilities), and a shimming element can attached with the clip, with the position and the size of the shimming element based upon the measured/determined location of the clip. In this regard, when the button is depressed, the shimming element may assist in providing a tactile input to the switch when the switch generates the input.

Also, during actuation of the button, the button remains planar. In other words, when there are no actuation forces on the button, the button is parallel, or at least substantially parallel, with respect to a sidewall (of the enclosure) through which the button protrudes. In this regard, the button assembly may include modifications such that when an actuation force is applied to an edge, or end, of the button, the button nonetheless remains flat. That is, there is little or no "rocking" or characteristics of a cantilevered button. The button assembly may include a bar, or roll bar, secured with the protrusions, with the bar designed to distribute the actuation force to the end of the button, and generate a pulling force to the opposing end of the button.

The bar may include a first arm connected to a first protrusion of the button (with the first protrusion position at a first end of the button), a second arm connected to a second arm of the button (with the second protrusion position at a second end of the button), and a longitudinal bar between the first arm and the second arm. As an exemplary operation of a button assembly, when an "off-center" force is applied to the first end, the first protrusion is actuated, thereby actuating the first arm and causing a rotational force to the first arm. The rotation force may provide a torque force to the longitudinal bar, and at least a portion of the torque force is exerted on the second arm. The exerted torque force on the second arm causes the second arm to rotate in a manner similar to that of the first arm, that is, in the same (rotational) direction as that of the first arm. As a result, the second arm provides a pulling force to the second end of the button, and the both first end and the second end of the button are displaced by the same distance, or approximately the same distance, and the button remains planar (or parallel with respect to the enclosure). The bar may include a relatively small diameter, and as a result, may include a material such as molybdenum in order to maintain a desired stiffness.

These and other embodiments are discussed below with reference to FIGS. 1-11. However, those skilled in the art will readily appreciate that the detailed description given herein with respect to these Figures is for explanatory purposes only and should not be construed as limiting.

FIG. 1 illustrates an isometric view of an electronic device 100, in accordance with some described embodiments. In some embodiments, the electronic device 100 is a laptop computer device. In other embodiments, the electronic device 100 is a wearable electronic device designed to secure with an appendage (such as a wrist) of a user of the electronic device 100. In the embodiment shown in FIG. 1, the electronic device 100 is a consumer electronic device, such as a mobile wireless communication device that takes the form of, for example, a smartphone or a tablet computer device.

The electronic device 100 may include an enclosure 102 having several sidewalls and a rear wall that combine to define an internal volume that receives several internal components (not shown), such as a processor circuit, a memory circuit, an internal power supply, sensors, a microphone, and speaker modules, as non-limiting examples. The enclosure 102 may be formed from a metal, such as aluminum or an alloy that includes aluminum. However, other materials are possible, such as a rigid plastic or ceramic. Also, when the enclosure 102 is formed from a metal, the enclosure 102 may undergo an anodization process that immerses the enclosure 102 in an anodic bath with one or more acidic compounds. The anodization process is designed to provide an aesthetic finish to the enclosure 102 as well as improve the structural rigidity.

The electronic device 100 may further include a display assembly 104 designed to present visual information, such as video or still images, to a user of the electronic device 100. The display assembly 104 may include a touch-sensitive layer that includes capacitive touch-sensitive technology, designed to respond to a touch input to the display assembly. The display assembly 104 may respond to the touch input by changing the visual information presented on the display assembly 104. Furthermore, the input or command may depend in part upon an amount of force applied to the display assembly 104. For example, a touch input applying a small amount of force may correspond to a command different from a command that includes a touch input applying a relatively larger amount of force.

The electronic device 100 may further include a protective layer 106 that covers the display assembly 104. Accordingly, a touch input event (described above) may also include a force applied to the protective layer 106. The protective layer 106 may include a transparent material, such as glass or sapphire.

The electronic device 100 may include external controls that provide an input or control to an internal component (such as a processor circuit, not shown) of the electronic device 100. For example, the electronic device 100 may include a button assembly 110 electrically coupled to a processor circuit in the electronic device 100. The button assembly 110 may include a button designed for actuation in order to provide a control or input. The button 112 may be actuated relative to the enclosure 102 in a direction toward the enclosure 102. In order to position the button assembly 110 in a location accessible to a user, the button assembly 110 may be disposed along an outer perimeter of the enclosure 102. In this regard, the enclosure 102 may include a sidewall 114 having an opening 116 to accommodate the button assembly 110. While the opening 116 may provide a pathway for contaminants, such as liquids, to enter the electronic device 100, the button assembly 110 may include modifications to limit or prevent contaminants from entering the opening 116. These modifications, as well as other structural components that promote actuation of the button assembly 110, will be shown and discussed below.

Figure 2:
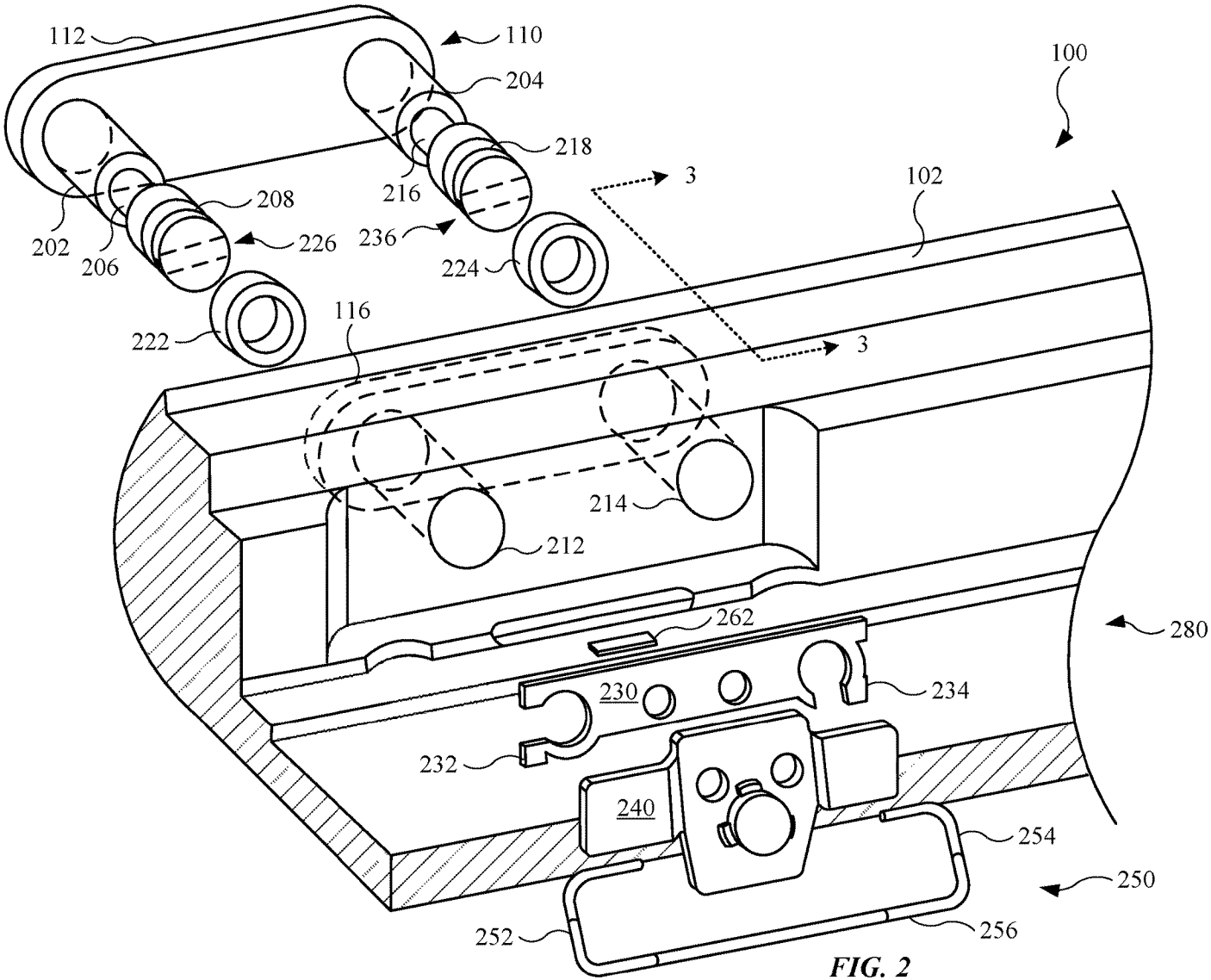
FIG. 2 illustrates an exploded view of the electronic device, showing the button assembly as well as various components used in conjunction with the button assembly.

FIG. 2 illustrates an exploded view of the electronic device 100, showing the button assembly 110 as well as various components used in conjunction with the button assembly 110. As shown, the button assembly 110 may include a button 112 that includes one or more protrusions, or pistons, extending from the button 112. For example, the button 112 may include a first protrusion 202 and a second protrusion 204. The first protrusion 202 and the second protrusion 204 are designed to move along with the button 112 when the button 112 is actuated. As shown, each protrusion is generally cylindrical in shape. However, other shapes are possible. In order for the electronic device 100 to receive the button 112, the opening 116 of the enclosure 102 may open to a first through hole 212 and a second through hole 214, both of which may open to the internal volume 280 defined by the enclosure 102. The first through hole 212 and the second through hole 214 are designed receive the first protrusion 202 and the second protrusion 204, respectively.

Also, each protrusion may include several grooves, or groove regions, defined by a relatively smaller diameter than that of the protrusion. For example the first protrusion 202 includes a first groove 206 and a second groove 208. The first groove 206 is designed to receive a first sealing element 222 that slides over the first protrusion 202 and onto the first groove 206. The first sealing element 222 may include a liquid-resistant, compliant material, such as silicone. Also, the first sealing element 222 may include a slip coating that covers an outer perimeter of the material. The slip coating promotes insertion of the first sealing element 222 into the first through hole 212, and also limits or prevents unwanted stretching of the material. In this regard, when the first protrusion 202 is extended through the first through hole 212, the first sealing element 222 engages the first through hole 212 and provides a seal against ingress that may pass around the button 112 and into the first through hole 212, thereby prevent liquid ingress into the internal volume defined by the enclosure 102. Also, once the first protrusion 202 is extended through the first through hole 212, the second groove 208 is designed to receive a clip 230, and in particular, designed to receive a first end 232 of the clip 230. This will be discussed further below. Also, the first through hole 212 and the second through hole 214 may include a surface roughness or surface texture different from other surfaces of the enclosure 102. This may allow the first sealing element 222 and the second sealing element 224 to move more easily through their respective through the first through hole 212 and the second through hole 214, respectively.

The second protrusion 204 may also include a first groove 216 and a second groove 218. Similar to the first groove 206 of the first protrusion 202, the first groove 216 of the second protrusion 204 is designed to receive a sealing element, such as a second sealing element 224. The second sealing element 224 may include any feature(s) described for the first sealing element 222. Also, when the second protrusion 204 is extended through the second through hole 214, the second sealing element 224 engages the second through hole 214 and provides a seal against ingress that may pass around the button 112 and into the second through hole 214, thereby prevent liquid ingress into the internal volume defined by the enclosure 102. As a result, the button 112, although requiring multiple openings in the enclosure 102, may nonetheless include liquid-resistant sealing element that provide an ingress barrier from liquids.

Also, once the second protrusion 204 is extended through the second through hole 214, the second groove 218 is designed to receive the clip 230, and in particular, designed to receive a second end 234 of the clip 230. The clip 230, located in an internal volume, is designed to facilitate insertion onto the protrusions. For example, as shown in FIG. 2, the first end 232 includes an opening designed to slide onto the second groove 208 of the first protrusion 202. Further, the second end 234 includes an opening designed to slide onto the second groove 218 of the second protrusion 204, with the opening at the second end 234 formed in a manner that is perpendicular with respect to the opening at the first end 232. In this manner, when the first end 232 is secured with the second groove 208 of the first protrusion 202, the clip 230 rotates (with respect to the first protrusion 202) onto the second groove 218 of the second protrusion 204, and the clip 230 secures the button 112 with the enclosure 102.

The button assembly 110 may further a shimming element 240 that secures with the clip 230. The shimming element 240 may "bridge" a gap between the clip 230 and a switch (not shown). In this manner, actuation of the button 112 also causes actuation of the first protrusion 202 and the second protrusion 204, resulting in actuation of the switch that closes an electrical contact and generates a command in the form of an electrical signal. Also, the shimming element 240 may be selected based upon a predetermined distance between the clip 230 and the switch. Hardware, such as a camera assembly with three-dimensional image capturing capabilities and/or a laser distance sensor, may perform the predetermination in conjunction with processor software suitable for use with the selected hardware.

Also, the button assembly 110 may further include a bar 250. In some embodiments, the bar 250 includes a roll bar designed to allow rotationally move. Further, in some embodiments, the bar 250 includes a relatively stiff material, such as molybdenum. However, other materials, including other metals and metal alloys, are possible. The bar 250 is designed to secure with the first protrusion 202 and the second protrusion 204. For example, the bar 250 may include a first arm 252 having an extension that fits into a first opening 226 (shown as dotted lines) of the first protrusion 202. The bar 250 may further include a second arm 254 having an extension that fits into a second opening 236 (shown as dotted lines) of the second protrusion 204. Each of the first opening 226 and the second opening 236 may form a through hole.

Generally, the button 112 is designed to move evenly and fluidly during actuation of the button 112, that is, when the button 112 is depressed to provide a control. In this regard, the button 112 is designed remain parallel with respect to the enclosure 102, and not "rock" during actuation, even when the button 112 is not depressed in a central (middle) region of the button 112. As an example, when the button 112 is depressed at a first end (in a location corresponding to the first protrusion 202), the first protrusion 202 may initially or momentarily move with respect to the second protrusion 204, causing the first arm 252 to initially rotate with respect to the second arm 254. However, he movement of the first arm 252 may cause a rotational force, or torque, exerted on the second arm 254 by way of a longitudinal portion 256 of the bar 250 that is connected to both the first arm 252 and the second arm 254. The rotational force translated to the second arm 254 causes the second arm 254 to mirror the rotation of the first arm 252. The rotation to the second arm 254 pulls the second protrusion 204, causing the second protrusion 204 to mirror the movement of the first protrusion 202. In this manner, even when the button 112 is depressed at one end, the button 112 maintains a parallel relationship with respect to the enclosure 102, as both the ends of the button 112 move together. This will be further shown and described below. Also, in order to assist in maintaining the bar 250 in a desired location, the enclosure 102 may include a pad 262 that engages the bar 250. In other words, the bar 250 may rest on the pad 262. Other structural features may be employed to limit some movement of the bar 250.

Figure 3:
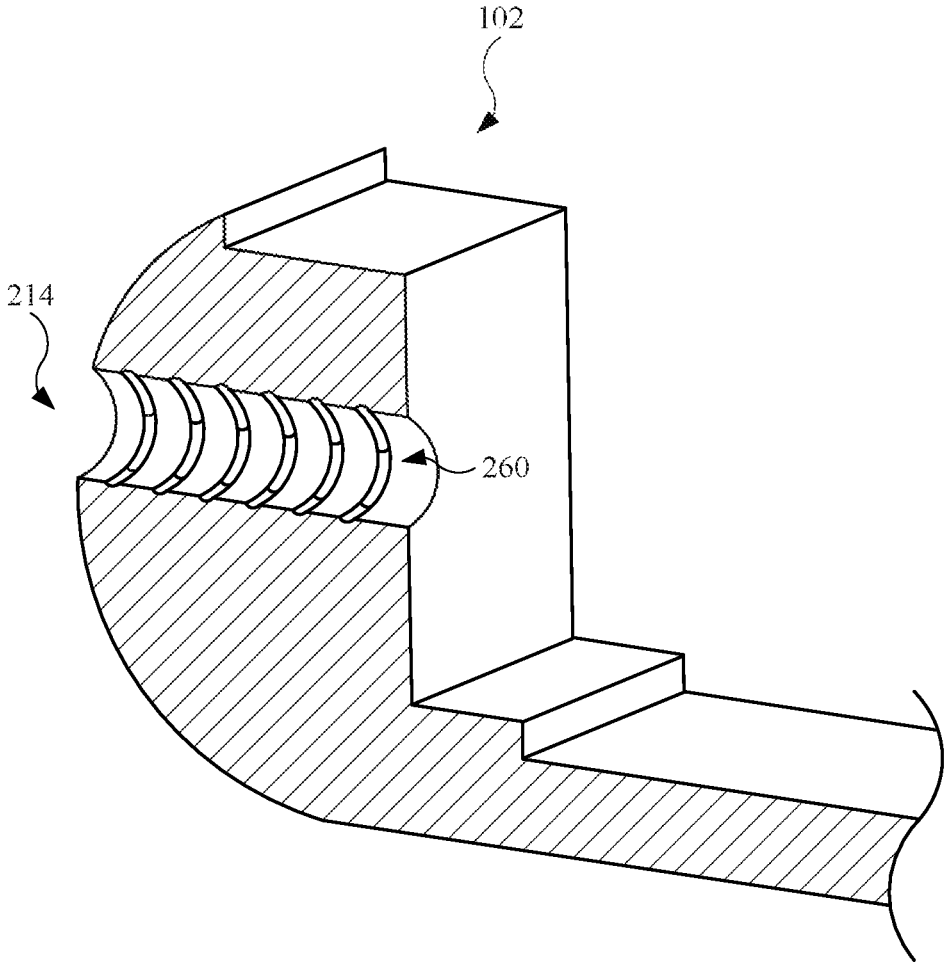
FIG. 3 illustrates a partial cross sectional view of the enclosure shown in FIG. 2, taken along line 3-3, showing an internal surface of the second opening having a textured region.

FIG. 3 illustrates a partial cross sectional view of the enclosure 102 shown in FIG. 2, taken along line 3-3, showing an internal surface of the second through hole 214 having a textured region 260. In order to form the first through hole 212 (shown in FIG. 2) and the second through hole 214, a drilling operation (not shown) is used. While the drilling operation may provide a relatively smooth internal surface (that defines the aforementioned openings), the internal surface may increase an attraction between the second sealing element 224 (shown in FIG. 2) and the second through hole 214, which can hinder insertion of the second sealing element 224 in the second through hole 214, and/or hinder movement of the second protrusion 204 (shown in FIG. 2) during actuation of the button 112.

However, the second through hole 214 may be modified in order to promote insertion of the second sealing element 224 into the second through hole 214, as well as decrease the attraction between the second sealing element 224 and the second through hole 214. In this regard, in conjunction with the drilling operation, or by a subsequent operation, a texturing operation may be applied to the second through hole 214 to form the textured region 260 to the internal surface. As shown, the textured region 260 includes a spiral pattern. However, other patterns are possible, such as a helical pattern or a rifling pattern, as non-limiting examples. Further, other operations, such as blasting or reaming are possible. It should be noted that an internal surface that defines the first through hole 212 (shown in FIG. 2) may include any type of textured region described or shown for the textured region 260 of the second through hole 214.

Figure 4:
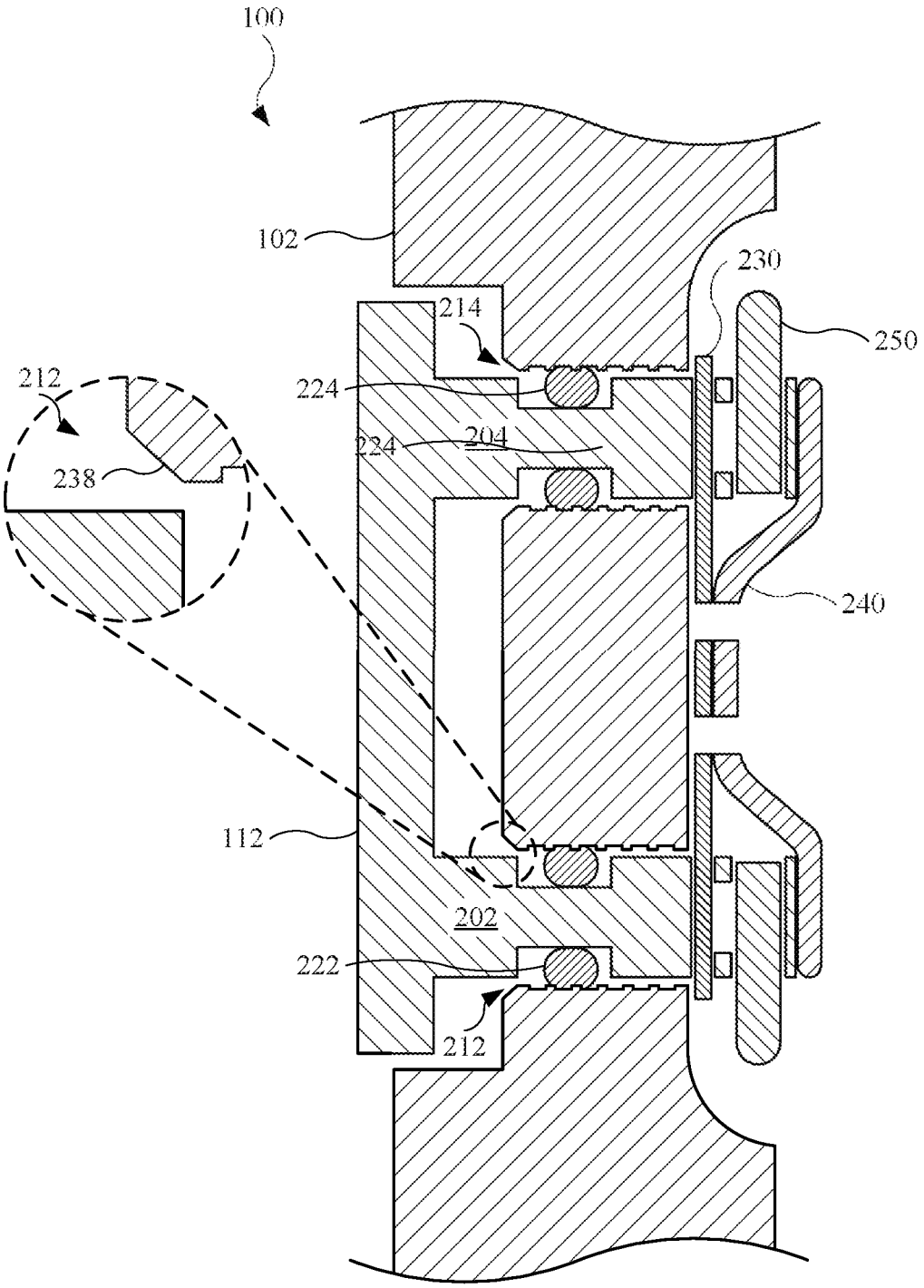
FIG. 4 illustrates a cross sectional view of the electronic device, showing the components of the button assembly compiled together.

FIG. 4 illustrates a cross sectional view of the electronic device shown in FIG. 2, showing the components of the button assembly 110 assembled together. As shown, the first protrusion 202 and the second protrusion 204 extend through the first through hole 212 and the second through hole 214, respectively, and secure with the clip 230. Also, as shown, the shimming element 240 is secured with the clip 230. Also, the bar 250 is secured with the first protrusion 202 and the second protrusion 204 by a manner previously described. As a result, the first sealing element 222 and the second sealing element 224 engage the first through hole 212 and the second through hole 214, respectively, to seal these openings and limit or prevent liquid ingress into the electronic device 100 through these openings. Also, the enclosure 102 may include chamfered regions around the openings to facilitate insertions of the protrusion, and in particular, insertion of the sealing elements into the openings. For example, as shown in the enlarged view, the first through hole 212 includes a chamfered region 238 surrounding the first through hole 212. Although not labeled, the second through hole 214 may include a chamfered region surrounding the second through hole 214.

Figure 5:
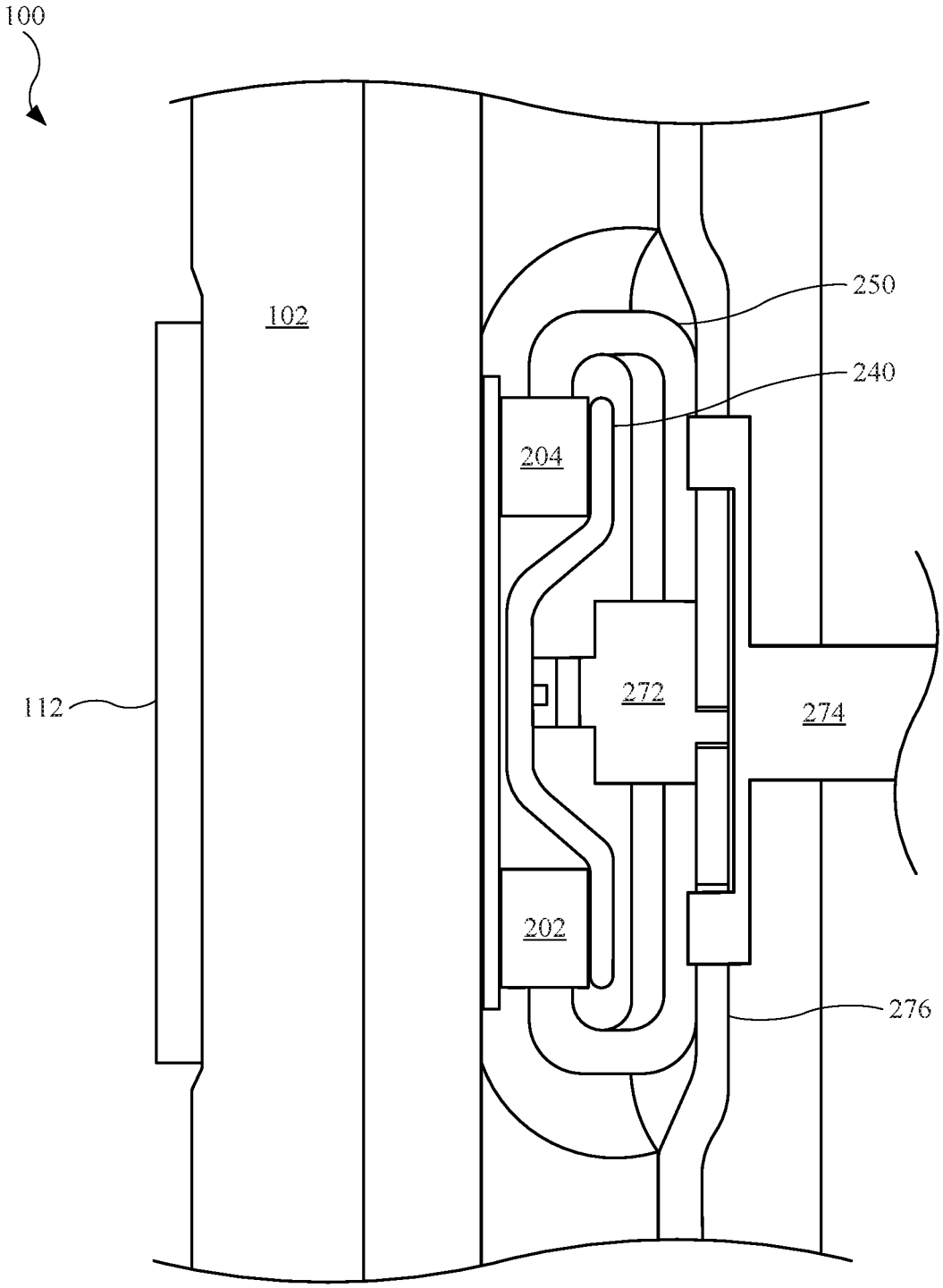
FIG. 5 illustrates a plan view of the electronic device, further showing additional components used with the button assembly.

FIG. 5 illustrates a plan view of the electronic device 100, further showing additional components used with the button assembly 110. For example, the electronic device 100 may include a switch 272 engaging the shimming element 240 in a manner such that a force applied to the button 112 is transferred to the switch 272, via way of the shimming element 240, to actuate the switch 272 and generate a control. Also, the electronic device 100 further includes a circuit 274, which may include a flexible circuit, electrically coupled with the switch 272. The electrical connection may include electrical contacts (not shown) between the switch 272 and the circuit 274. The circuit 274 is designed to carry the control generated by actuation of the switch 272, with the control in the form of electrical signals sent to a processor circuit (not shown) that is in electrical communication with the circuit 274, and accordingly, in communication with the switch 272. The electronic device 100 may further include a bracket 276 fastened with the enclosure 102. The fastening means may include one or more fasteners (not shown) in the form of screws. Further, the bracket 276 may be fastened with the enclosure 102 such that the bracket 276 engages the bar 250. In this manner, the bracket 276 maintains the bar 250 partially in place while the first protrusion 202 and/or the second protrusion 204 provide a force (during actuation of the button 112) that rotates of the aforementioned arms of the bar 250. This will be further described below.

Figure 6:
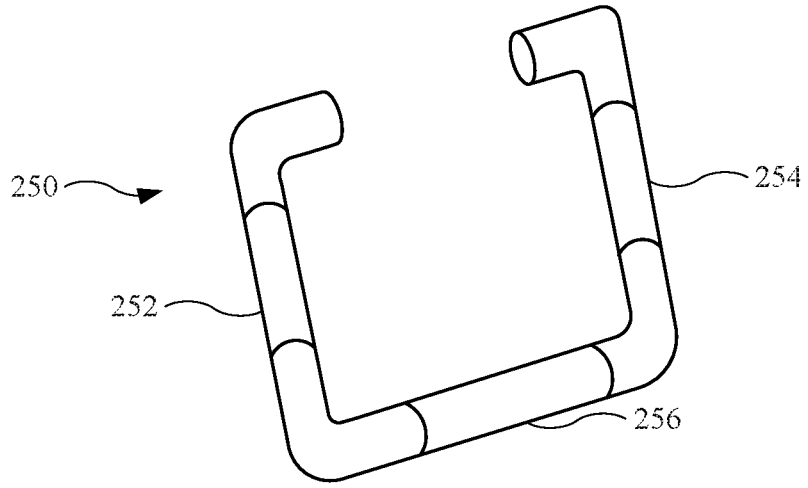
FIG. 6 illustrates an isometric view of the bar, in accordance with the described embodiments.
Figure 7:
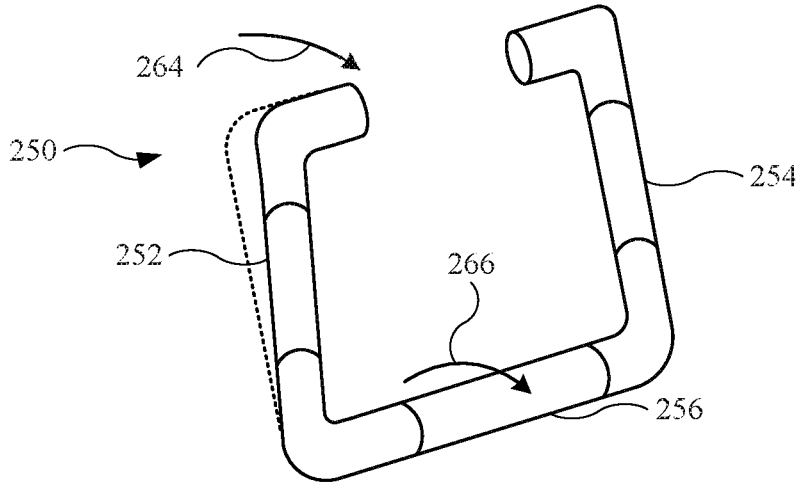
FIG. 7 illustrates an isometric view of the bar shown in FIG. 6, further showing a force applied to the first arm of the bar, causing the first arm to rotate.
Figure 8:
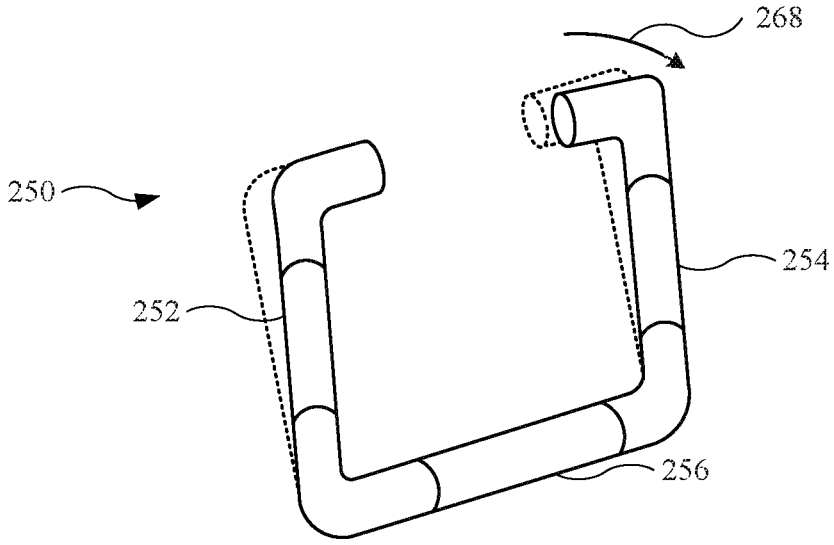
FIG. 8 illustrates an isometric view of the bar shown in FIG. 7, further showing the second arm rotating in accordance with the force applied to the first arm.

FIGS. 6-8 show and described the movement of the bar 250 (also shown in FIG. 4). The bar 250 may be used to "balance" the button 112 (shown in FIG. 4) such that the button 112 does not rock or move in accordance with the cantilevered movement. In other words, the bar 250 may facilitate the button 112 remaining parallel, or at least approximately parallel, with respect to the enclosure 102 (shown in FIG. 5) during actuation of the button 112.

FIG. 6 illustrates an isometric view of the bar 250, in accordance with the described embodiments. As previously described, the bar 250 may include a first arm 252 designed to engage the first protrusion 202 (shown in FIG. 4), a second arm 254 designed to engage the second protrusion 204 (shown in FIG. 4), and a longitudinal portion 256 connected to the first arm 252 and the second arm 254. The phrase "connected to" refers to a transition region(s) between structural features of the bar 250 such that the bar 250 is formed from a continuous piece of material (or a continuous piece of a combination of materials, in the case of the bar 250 being formed from a metal alloy).

FIG. 7 illustrates an isometric view of the bar 250 shown in FIG. 6, further showing a force (in a direction of an arrow 264) applied to the first arm 252 of the bar 250, causing the first arm 252 to rotate with respect to the second arm 254. During actuation of the button 112, a force is transferred to the first protrusion 202 (shown in FIG. 4), causing rotation of the first arm 252 in the direction of the arrow 264. Also, the rotation of the first arm 252 may cause a rotational force, or torque, in the form of a twisting action that is transferred to the longitudinal portion 256, such that the longitudinal portion 256 will twist or rotate in a direction of an arrow 266, with the direction of the arrow 266 similar, or substantially similar, to that of the arrow 264.

The rotation, or twisting action, of the longitudinal portion 256, may transfer a force to other parts of the bar 250. For example, FIG. 8 illustrates an isometric view of the bar 250 shown in FIG. 7, further showing the second arm 254 rotating in accordance with the force applied to the first arm 252. The force applied to the longitudinal portion 256 is at least partially transferred to the second arm 254, such that the second arm 254 will twist or rotate in a direction of an arrow 268, with the direction of the arrow 268 similar, or substantially similar, to that of the arrow 266. As shown, the rotation of the second arm 254 may mirror, or approximately mirror, the rotation of the first arm 252. In this regard, when the second arm 254 is secured with the second protrusion 204 (shown in FIG. 4), the second arm 254 actuates the second protrusion 204 such that the second protrusion 204 moves in accordance with the first protrusion 202, thereby keeping the button 112 parallel, or approximately, parallel with respect to the enclosure 102 (shown in FIG. 4).

While FIGS. 6-8 show a series of steps, these steps shown and described may be initiated by a single event, such as actuation to the button 112 (shown in FIG. 4). In other words, the series of steps may occur in a manner such that rotational movement of the second arm 254 occurs shortly after rotational movement of the first arm 252. Further, the bar 250 can be particular useful when a central portion of the button is not depressed, but rather a single end (associated with a location corresponding to the first protrusion 202 or the second protrusion 204) is depressed. In this manner, during actuation of the button 112, the button 112 remains parallel, or approximately, parallel with respect to the enclosure 102 (shown in FIG. 4). This will be shown and described below.

Figure 9:
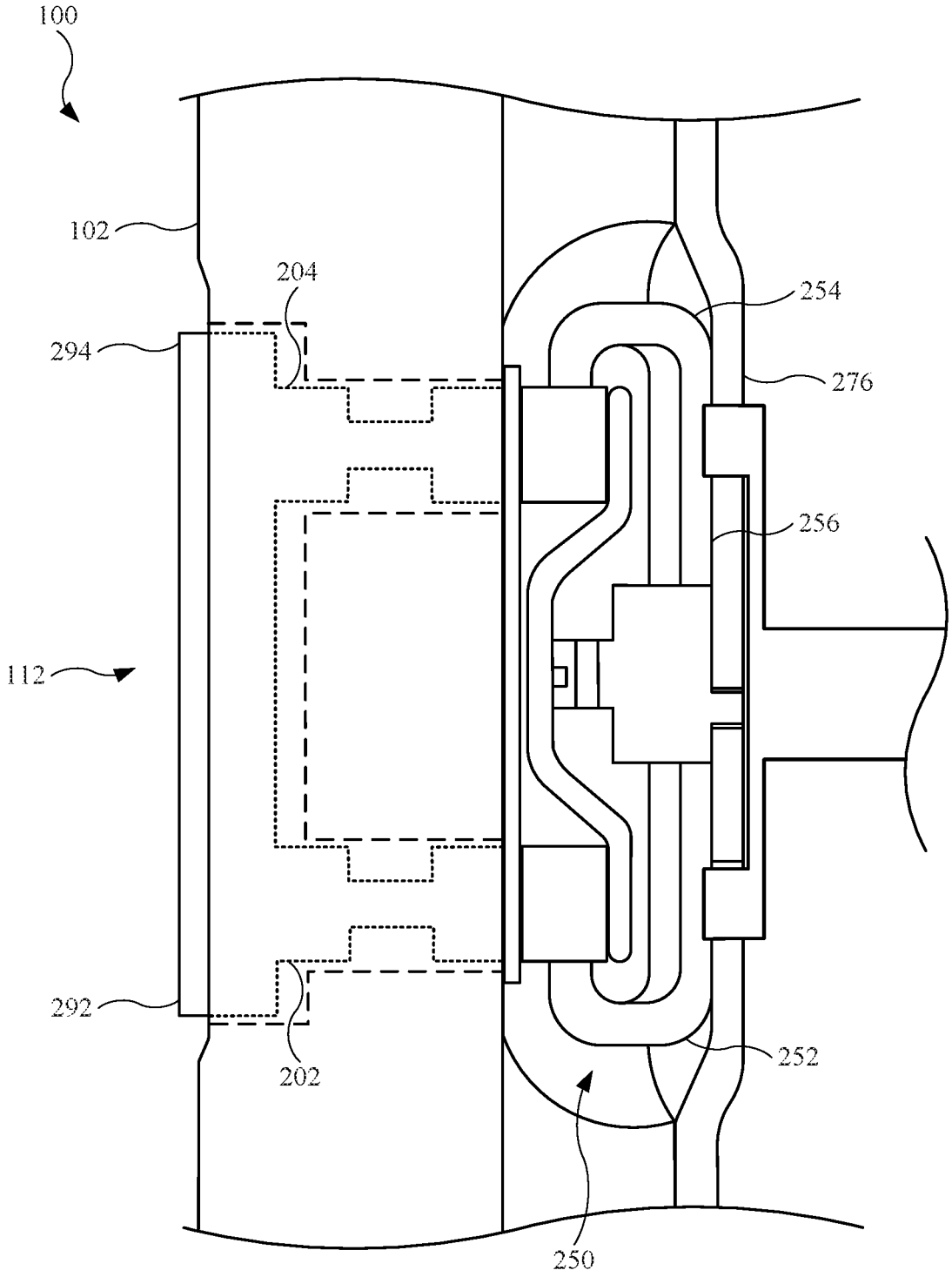
FIG. 9 illustrates a plan view of the button positioned within the enclosure, further showing the first protrusion and the second protrusion secured with the bar, in accordance with some described embodiments.

FIG. 9 illustrates a plan view of the button 112 positioned within the enclosure 102, further showing the first protrusion 202 and the second protrusion 204 secured with the bar 250, in accordance with some described embodiments. As shown, the button 112 may include a first end 292 and a second end 294, with the first end 292 and the second end 294 generally at or near opposing edges of the button 112. As shown, the bar 250 is engaged with the first protrusion 202 at the first arm 252, and also engaged with the second protrusion 204 at the second arm 254. In this manner, movement of the button 112 may cause the first protrusion 202 or the second protrusion 204 to move, thereby causing the first arm 252 or the second arm 254, respectively, to move. This will be illustrated below. The electronic device 100 may include a bracket 276 secured with the enclosure 102 and engaged with the bar 250. As shown, the bracket 276 is engaged with the longitudinal portion 256 of the bar 250. During movement of the first arm 252 and/or the second arm, the bracket 276 may limit certain movement or displacement of the longitudinal portion 256. However, the bracket 276 may nonetheless allow the longitudinal portion 256 to rotationally move in a manner previously described.

Figure 10:
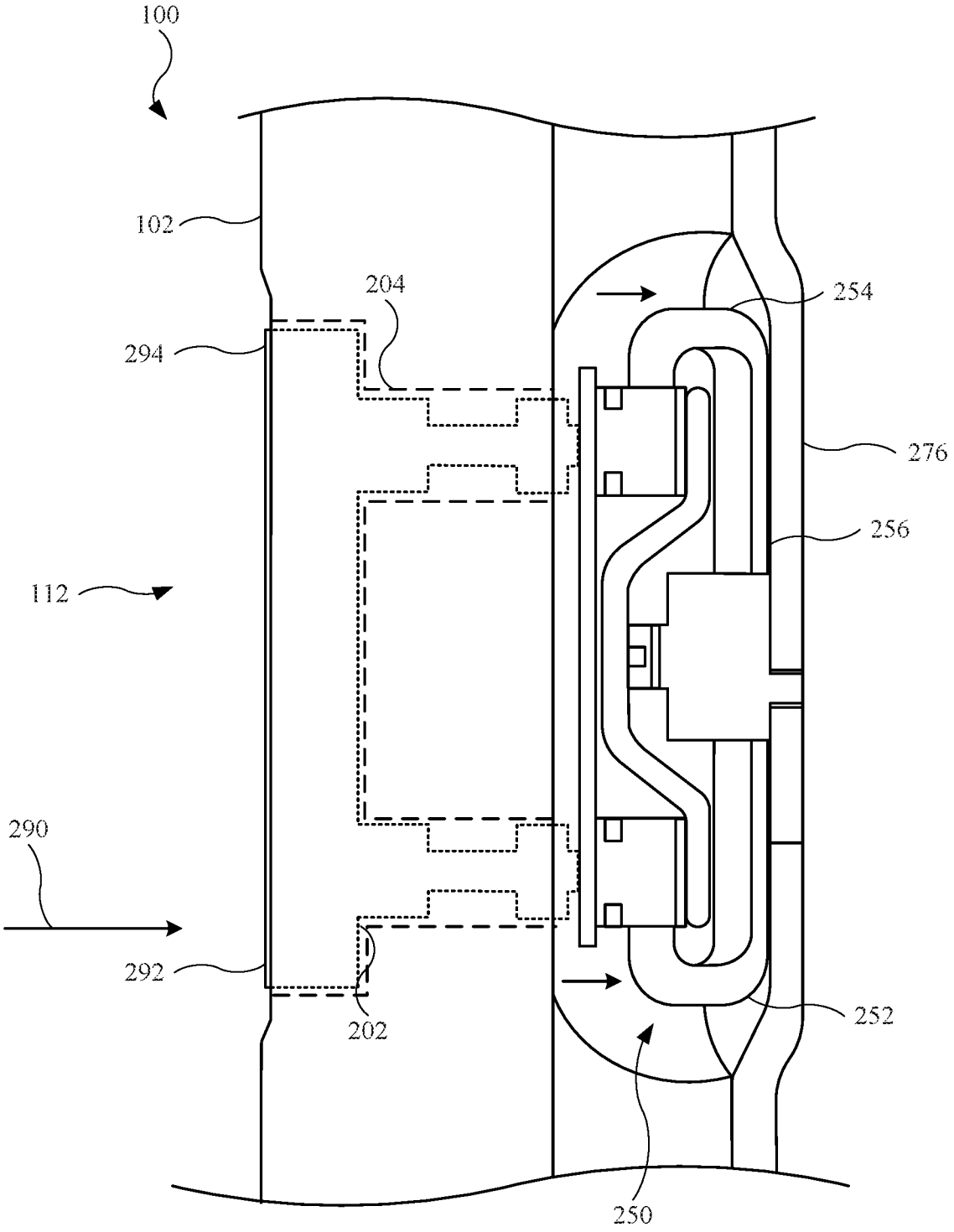
FIG. 10 illustrates a plan view of the electronic device, showing the bar actuated in response to actuation of the button.

FIG. 10 illustrates a plan view of the electronic device 100 shown in FIG. 9, showing the bar 250 actuated in response to actuation of the button 112. As shown, a force (denoted by arrows 290) is applied to a first end 292 of the button 112. It should be noted that in FIG. 10 the force is generally not applied to a second end 294 of the button 112. When the force is applied to the first end 292, the button 112 moves and causes the first protrusion 202 to move in a direction toward the bracket 276. The movement of the first protrusion 202 causes the first arm 252 to rotate. The rotation of the first arm 252 exerts a rotational force, or torque, to the longitudinal portion 256. This may include some rotation or twisting of the longitudinal portion 256. Further, at least some of the rotational force applied to the longitudinal portion 256 is also exerted on the second arm 254. The torque applied to the second arm 254 causes the second arm 254 to rotate in a manner similar to that of the first arm 252. Also, the rotation of the second arm 254 causes the second protrusion 204 to move, thereby causing movement of the second end 294 of the button 112. In this manner, during auction of the button 112, the button 112 maintains a parallel, or approximately parallel, relationship with the enclosure 102. It should be noted that a force applied to the second end 294 may ultimately cause the first end 292 to move in accordance with the second end 294 in a similar manner.

Figure 11:
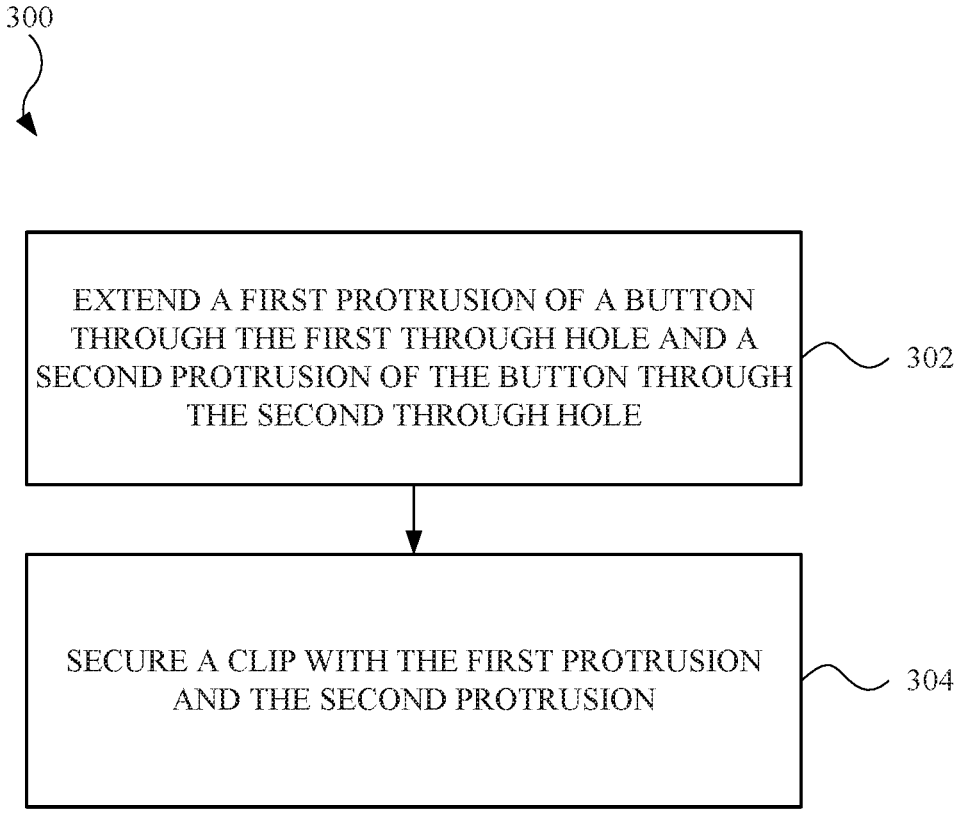
FIG. 11 illustrates a flowchart showing a method for assembling a button assembly with an electronic device having a first through hole and a second through hole, in accordance with some described embodiments.

FIG. 11 illustrates a flowchart 300 showing a method for assembling a button assembly with an electronic device having a first through hole and a second through hole, in accordance with some described embodiments. In step 302, a first protrusion of a button is extended through the first through hole and a second protrusion of the button through the second through hole.

In step 304, a clip is secured with the first protrusion and the second protrusion. Each of the first protrusion and the second protrusion may include a groove to receive the clip. Also, the first protrusion may include a first sealing element that seals the first through hole. Also, the second protrusion may include a second sealing element that seals the second through hole. In this regard, the through holes may be sealed from liquid ingress.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A button assembly for an electronic device that includes an enclosure, the button assembly comprising:

a button;

a first cylindrical protrusion extending from the button and comprising a first sealing element that engages a first through hole of the enclosure, the first cylindrical protrusion defining a first end attached to the button and a second end opposite the first end;

a first opening formed along a first curved surface defined by the first cylindrical protrusion, the first opening enclosed between the first end and the second end;

a second cylindrical protrusion extending from the button and comprising a second sealing element that engages a second through hole of the enclosure, the second cylindrical protrusion defining a third end attached to the button and a fourth end opposite the third end;

a second opening formed in a second curved surface defined by the second cylindrical protrusion, the second opening enclosed between the third end and the fourth end; and a bar passing through the first opening and the second opening, the bar capable of distributing a force applied to button from the first protrusion to the second protrusion.

2. The button assembly of claim 1, wherein the first protrusion extends from a first end of the button, and wherein the second protrusion extends from a second end of the button, the second end opposite the first end, and wherein the bar includes:

a first arm secured with the first protrusion at the first opening; and a second arm with the second protrusion at the first opening, and when the first end is depressed, the protrusion actuates the first arm, causing a rotational force to the second arm, thereby actuating the second protrusion and the second end.

3. The button assembly of claim 2, wherein the button remains parallel with respect to the electronic device when the button is depressed.

4. The button assembly of claim 2, wherein the bar includes a longitudinal portion connected to the first arm and the second arm, the longitudinal portion perpendicular with respect to the first arm and the second arm.

5. The button assembly of claim 1, further comprising a clip that secures the button with the electronic device, the clip having a first end and a second end opposite the first end, wherein:

the first protrusion includes a first groove that receives the first end, and the second protrusion includes a second groove that receives the second end.

6. The button assembly of claim 1, wherein the first through hole is formed into the first cylindrical protrusion, and wherein the second hole is formed into the second cylindrical protrusion.

7. The button assembly of claim 1, wherein:

the first opening is formed between a first end and a second end of the first cylindrical protrusion, the second opening is formed a first end and a second end of the second cylindrical protrusion, the first cylindrical protrusion defines a first single piece body, and the second cylindrical protrusion defines a second single piece body.

8. The button assembly of claim 1, further comprising a clip having a first opening that opens along a first surface and a second opening that opens along a second surface perpendicular to the first surface, the first cylindrical protrusion positioned in the first opening and the second cylindrical protrusion positioned in the second opening.

9. An electronic device, comprising:

an enclosure that defines an internal volume, the enclosure comprising a first through hole and a second through hole;

a button including a first protrusion extending through the first through hole and a second protrusion extending through the second through hole, the first protrusion and the second protrusion at least partially extending into the internal volume;

a first sealing element fitted onto the first protrusion and engaging the first through hole to form a first liquid barrier;

a second sealing element fitted onto the second protrusion and engaging the second through hole to form a second liquid barrier; and a clip having a first opening that opens along a first surface and a second opening that opens along a second surface perpendicular to the first surface, the first protrusion positioned in the first opening and the second protrusion positioned in the second opening.

10. The electronic device of claim 9, further comprising:

a shimming element secured with the clip; and a switch, wherein when the button is actuated, the first protrusion and the second protrusion actuate in accordance with the button, causing the shimming element to engage and actuate the switch.

11. The electronic device of claim 9, further comprising a roll bar having a first arm secured the first protrusion and a second arm secured with the second protrusion, wherein:

the button comprises a first end corresponding to the first protrusion and a second end corresponding to the second protrusion, and when the first end is depressed, the first protrusion actuates the first arm, causing a torque force to the second arm thereby actuating the second protrusion and the second end.

12. The electronic device of claim 11, wherein the first protrusion includes:

a first opening that receives the first arm; and a second opening that receives the second arm.

13. The electronic device of claim 11, wherein the roll bar comprises molybdenum.

14. The electronic device of claim 11, further comprising:

a switch actuated in accordance with an actuating force to the button;

a circuit electrically coupled to the switch; and a bracket that carries the circuit, the bracket engaging the roll bar.

15. The electronic device of claim 9, wherein the first through hole comprises a textured region comprising multiple grooves.

16. A method for assembling a button assembly with an electronic device that includes an enclosure having a first through hole and a second through hole, the method comprising:

extending a first protrusion of a button through the first through hole, the first protrusion comprises a first sealing element that seals the first through hole;

extending a second protrusion of the button through the second through hole, the first protrusion comprises a first sealing element that seals the second through hole; and securing a clip with the first protrusion and the second protrusion, the clip having a first opening that opens along a first surface and a second opening that opens along a second surface perpendicular to the first surface, the first protrusion positioned in the first opening and the second protrusion positioned in the second opening.

17. The method of claim 16, further comprising securing a bar with the first protrusion and the second protrusion, the bar configured to distribute force from the first protrusion to the second protrusion.

18. The method of claim 17, further comprising securing a bracket with the enclosure, the bracket engaged with the bar.

19. The method of claim 16, further comprising securing the clip with a first groove in the first protrusion, and securing the clip with a second groove in the second protrusion.

20. The method of claim 16, further comprising:

securing a shimming element with the clip; and securing a switch between the first protrusion and the second protrusion, wherein when the button is actuated, the first protrusion and the second protrusion actuate in accordance with the button, causing the shimming element to actuate the switch.

* * * * *